US007484703B2

(12) United States Patent
Krinner

(10) Patent No.: US 7,484,703 B2
(45) Date of Patent: Feb. 3, 2009

(54) CHRISTMAS TREE STAND WITH ELASTIC ELEMENT THAT ENGAGES POWER TRANSMISSION ELEMENT

(75) Inventor: Klaus Krinner, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 261 days.

(21) Appl. No.: 11/291,684

(22) Filed: Dec. 1, 2005

(65) Prior Publication Data

US 2006/0186305 A1 Aug. 24, 2006

(30) Foreign Application Priority Data

Dec. 27, 2004 (DE) ..... 10 2004 062 826

(51) Int. Cl.
*F16M 13/00* (2006.01)

(52) U.S. Cl. ..... 248/519; 248/525; 47/40.5; D11/130.1

(58) Field of Classification Search ..... 248/525, 248/523, 519, 524, 527; 47/40.5; D11/130.1
See application file for complete search history.

(56) References Cited

U.S. PATENT DOCUMENTS

| | | | | | |
|---|---|---|---|---|---|
| 2,023,340 | A * | 12/1935 | Peskulich | 248/524 |
| 5,114,113 | A * | 5/1992 | Krinner | 248/525 |
| 5,467,959 | A * | 11/1995 | Behringer | 248/523 |
| 5,673,893 | A * | 10/1997 | Klein | 248/525 |
| 5,797,579 | A * | 8/1998 | Krinner | 248/523 |
| 6,012,698 | A * | 1/2000 | Hardt et al. | 248/523 |
| 6,094,859 | A * | 8/2000 | Kalman et al. | 47/40.5 |
| 6,253,458 | B1 * | 7/2001 | Raab et al. | 33/503 |
| 6,283,436 | B1 * | 9/2001 | Schulz et al. | 248/523 |
| 6,854,700 | B2 * | 2/2005 | Schmitz | 248/523 |
| 6,988,702 | B2 * | 1/2006 | Schulz | 248/525 |
| 2004/0135042 | A1 * | 7/2004 | Krinner et al. | 248/158 |
| 2006/0186305 | A1 * | 8/2006 | Krinner | 248/523 |
| 2007/0012851 | A1 * | 1/2007 | Krinner | 248/524 |

FOREIGN PATENT DOCUMENTS

| | | |
|---|---|---|
| DE | 39 32 473 | 4/1991 |
| DE | 299 04 893 | 7/1999 |
| DE | 200 08 849 | 8/2000 |
| DE | 100 00 879 | 7/2001 |
| DE | 201 03 313 | 5/2002 |
| DE | 202 00 317 | 6/2002 |
| DE | 201 22 219 | 11/2004 |
| EP | 0 983 010 | 3/2003 |

* cited by examiner

*Primary Examiner*—Kimberly T Wood
(74) *Attorney, Agent, or Firm*—Jordan and Hamburg LLP

(57) ABSTRACT

Tree stand in which a tensioning device can move a plurality of retaining elements that are arranged about the axis of the receiving area of the stand, by means of a flexible force transmission element that can be loaded with tension, out of a loose position in which the trunk can be adjusted into a support position in which the retaining elements are positioned largely force-free on the trunk, then into an alignment position in which the retaining elements hold the trunk so that it can be aligned, finally into a retaining position in which the trunk is clamped upright, whereby the lower retaining force of the plurality of retaining elements, which force is required in the alignment position, is produced by an elastic buffer element allocated to the force transmission element.

10 Claims, 5 Drawing Sheets

CHRISTMAS TREE STAND WITH ELASTIC ELEMENT THAT ENGAGES POWER TRANSMISSION ELEMENT

BACKGROUND OF THE INVENTION

The invention relates to a tree stand, in particular a Christmas tree stand, in which a tensioning device tautens a flexible force transmission element that can be loaded with tension such that a plurality of retaining elements are moved therewith from a loose position into a retaining position.

Such Christmas tree stands are known. For instance, U.S. Pat. No. 5,114,113 describes a Christmas tree stand that has a foot piece, a receiving part arranged thereon for the trunk of a Christmas tree, a plurality of retaining elements arranged about an axis of symmetry, and a tensioning device that engages all of the retaining elements via a force transmission element in the form of a flexible connector that can be loaded with tension. Furthermore, there is also a solution in accordance with DE 100 00 879 A1 in which the force transmission element engages more than one, e.g. two, groups of retaining elements. When the tensioning device is actuated, the retaining elements are pivotable between a loose position and a retaining position, each position in one plane, whereby the planes approximately intersect the aforesaid axis of symmetry. When the tensioning device is actuated, the retaining elements are first placed against the trunk largely with no force (starting position), then all of the retaining elements are pressed against the trunk of the Christmas tree at one time and with largely the same retaining force. Due to its high degree of reliability and ease of handling, this Christmas tree stand already enjoys broad use, especially because it even works reliably when, as is frequently the case for naturally grown trees, the tree trunk is not round and the retaining elements therefore cannot simultaneously be placed against the trunk. Because only one force transmission element, preferably a steel cable, is used that is introduced into the retaining elements slidingly movable, no retaining force is exerted until all of the retaining elements have been placed against the tree trunk, where necessary one after the other. When the tensioning device is actuated again, the retaining elements are than held against the trunk at one time with enough force to retain the latter in its position (retaining position).

One known stand (U.S. Pat. No. 6,283,436, the disclosure of which is hereby incorporated herein by reference) works in a very similar manner in that the force transmission element is constructed in multiple parts, specifically from two cable pulls, that, on the side of the stand opposing the tensioning apparatus, are joined to one another by a rocker that can be pivoted about a vertical axis and form a force transmission element that engages a group of retaining elements with each of its cables (every two cables in this case).

Given all of the indisputable handling advantages, especially for the first aforesaid tree stand, in practice it has been shown that aligning the tree involves certain difficulties, especially if one person attempts to do so without assistance. Above all, if the trunk does not have a circular cross-section the retaining elements are placed against the tree trunk one after the other largely with no force when the tensioning device is actuated. That is, they do not yet exert any retaining force in this position. Initially fixing the tree just enough that the retaining force of the retaining elements is adequate to retain the tree in the stand temporarily, for instance for more precise alignment, is very difficult. The ratcheting device permits tensioning only in steps/stages. Because retaining elements and force transmission element, which have to transmit the great retaining forces, are correspondingly designed with the strength and consequently with little flexibility and therefore transmit the tensioning steps as the tensioning device generates them, that is, by step or stage. The result is that the trunk is not yet held when the tensioning device is in a certain position because the retaining elements have not all been completely placed against the trunk yet, but the trunk is already clamped with enough retaining force in the next ratchet position, which is defined by the tooth size, that it is no longer possible to align it because the retaining forces are too great. This difficulty is exacerbated when the retaining elements, as is common, are provided with pointed tips or claws. Because these dig into the trunk as soon as the user attempts to push the tree in the desired direction in order to align it, and indeed sink deeper into the trunk the more the user makes this attempt.

Consequently, the object of the invention is to provide a Christmas tree stand with a force transmission element, in particular a cable, in which, for the purposes of alignment, the trunk can be temporarily fixed such that it remains stationary without other retaining measures and does not fall over but can still be aligned.

SUMMARY OF THE INVENTION

This inventive tree stand is distinguished from the aforesaid prior art in that allocated to the force transmission element, for instance a steel cable that is only slightly extensible as such, is an elastic buffer element that is designed such that the retaining position no longer practically immediately follows the starting position, but rather the two positions are clearly separated from one another, specifically using an intermediate position that the user can make use of and utilize and that must be employed during the tensioning process, in which position the force transmission element presses the retaining elements against the trunk with enough force that it does not fall over when the user lets go of it, but this pressing force is clearly lower than the force that is required for lastingly retaining the trunk in the retaining position, and, since this pressing force is produced at least in part by the elastic buffer element as well, can easily be overcome for aligning the trunk without damaging the mechanical parts (aligning position). This is effected in that the force transmission element first positions the retaining elements against the trunk under the pre-tension of the elastic buffer element and the full retaining force therefore cannot be applied until the buffer effect of the elastic element has been used up. In the case of trunks that are not round, first a retaining element or a few of the retaining elements are positioned against the trunk and as a result of the effect of the elastic buffer element, in contrast to a stand in accordance with the prior art, a certain force is exerted that is produced by the effect of the elastic buffer element. However, this force is not great enough that without further actuation of the tensioning device the condition could be reached in which all retaining elements are positioned against the trunk with a certain force, which is clearly less than the retaining force that is adequate however for retaining the trunk in this intermediate position for the purpose of alignment. "Largely with no force" in the sense of the defined starting position in this context means a condition in which the retaining elements exert a certain relatively small force on the trunk but this force is not adequate to retain the trunk in a position provided for alignment.

Depending on the design of the tensioning device and the retaining elements, the transition from the alignment position to the retaining position can be attained all at once or also by actuating the tensioning device multiple times.

The elastic buffer element can preferably engage the force transmission element itself with a force component directed away from the axis of the receiving part and can furthermore preferably be a helical spring. The structural simplicity of this option recommends it.

However, the buffer element can alternatively also act in the tensioning force direction of the force transmission element. There are in particular two options for this:

First, the elastic buffer element can be the force transmission element itself, which is embodied for instance as an elastic cable.

However, the elastic buffer element can also be arranged in the tensioning force direction of the force transmission element, for instance of a non-extensible steel cable, for instance as a spring at at least one position between its ends.

Alternatively, the buffer element can also be arranged in the area of the tensioning device or in the solution in accordance with U.S. Pat. No. 6,283,436, i.e., in a force transmission device that comprises two cables joined to one another by a pivotable rocker, in the area of the rocker, whereby the tensioning device or the rocker is elastically borne using the buffer element such that when it is tautened against the spring force of the elastic buffer element it can be moved radially in the direction of the axis of the receiving part.

In order to further facilitate the alignment despite the pressure already resting on the retaining elements, in particular to prevent the retaining elements from digging into the trunk when the tree is moved for alignment, the retaining areas of the retaining elements provided for placement against the trunk are preferably provided with arched or curved or rounded and smooth or slidable support surfaces, i.e. no tip or bevel or sharp edge should be provided.

Instead, the support surfaces can be toothed, whereby these teeth are preferably designed such that they do not dig into the trunk until the pressures exerted in the retaining position are reached, but not at the pressures exerted in the alignment position. The tips of the teeth can preferably be flattened for this.

In order to further improve the elasticity of the system in the starting position, the retaining elements can be embodied with flexible tongues and/or elastomer in their retaining areas or each can be provided with a spring buckle or a spring block.

It has also proved advantageous to embody the support surface of the retaining elements as slide surfaces, preferably as cylindrical/roller-shaped resilient or rigid bodies that are arranged with their longitudinal axis preferably tangential to the receiving area. If they are embodied rigid, the trunk in the alignment position slides on them particularly well so that alignment is facilitated. If they are more or less elastic, they also support the elasticity of the system (like the spring elements suggested in the foregoing), and the slidability does not suffer from this.

Particularly functional is a tree stand in which, firstly, the elastic buffer element is arranged in the area of the tensioning device, whereby the tensioning device is elastically borne such that, when the force transmission element is tautened against the spring force of the elastic buffer element, the tensioning device is radially movable in the direction of the axis of the receiving part, and in which, secondly, the force transmission element, for instance a steel cable on the side of the stand opposing the tensioning device is guided such that it slides on the receiving part, for instance in an eye fixed on the receiving part, and in which, thirdly, the retaining areas of the retaining elements, or their support surfaces, are embodied as preferably cylindrical/roller-shaped resilient or rigid bodies that are arranged with their longitudinal axis preferably tangential to the receiving part. The slidable bearing of the force transmission element on the side opposing the tensioning element collects the tensioning forces that occur during tensioning and that are oriented toward the tensioning element, and in addition prevents forces from acting laterally on the retaining elements and improves the uniform distribution of the pressing forces on the retaining elements. The configuration of the retaining areas and of their support surfaces as bodies that are roller-shaped or the like makes it easier for the trunk to slide on them and thus further facilitates alignment. If these bodies are embodied elastically, they also improve the elasticity of the entire system, and their slidability does not have to suffer for this. These bodies preferably have a length that is longer than the width of the retaining elements so that they have the shape of cylinders or rollers attached transversely to the retaining elements. These bodies can preferably also be added to present stands/retaining elements, preferably by means of a clip connection.

The elastic buffer elements should be designed such that the pre-tension of the force transmission element generated by the buffer element continues in the retaining position. Because then the additional advantage results that the retaining elements create a tensioning effect so that, for instance if the trunk shrinks due to drying, sufficient retaining force remains so that the trunk does not loosen.

Additional details and advantages of the present invention result from the following description of exemplary embodiments with reference to hereto appended drawings.

DETAILED DESCRIPTION OF THE INVENTION

Figure 1:
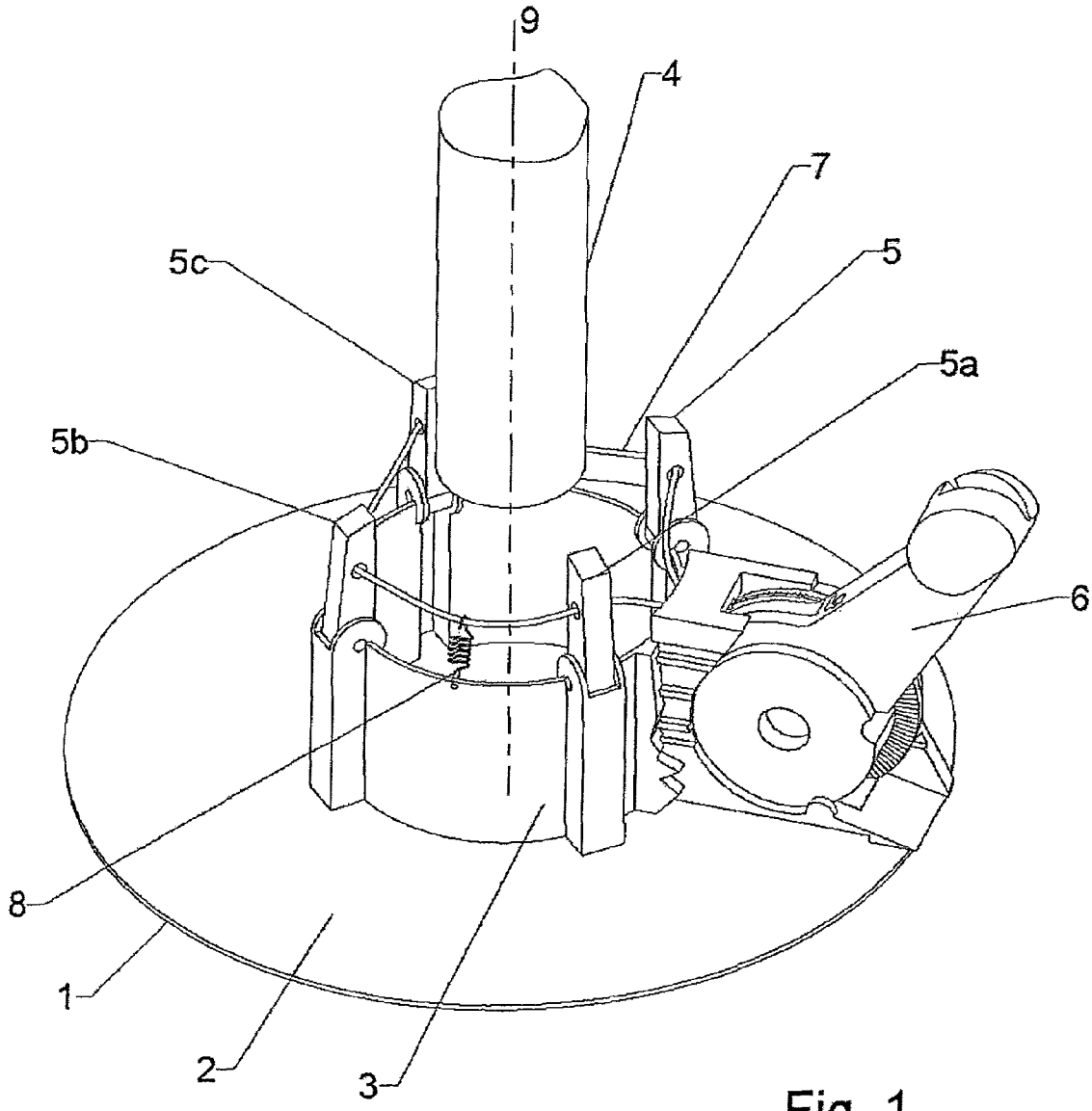
FIG. 1 is a schematically highly simplified perspective depiction of a first embodiment of the tree stand.
Figure 2:
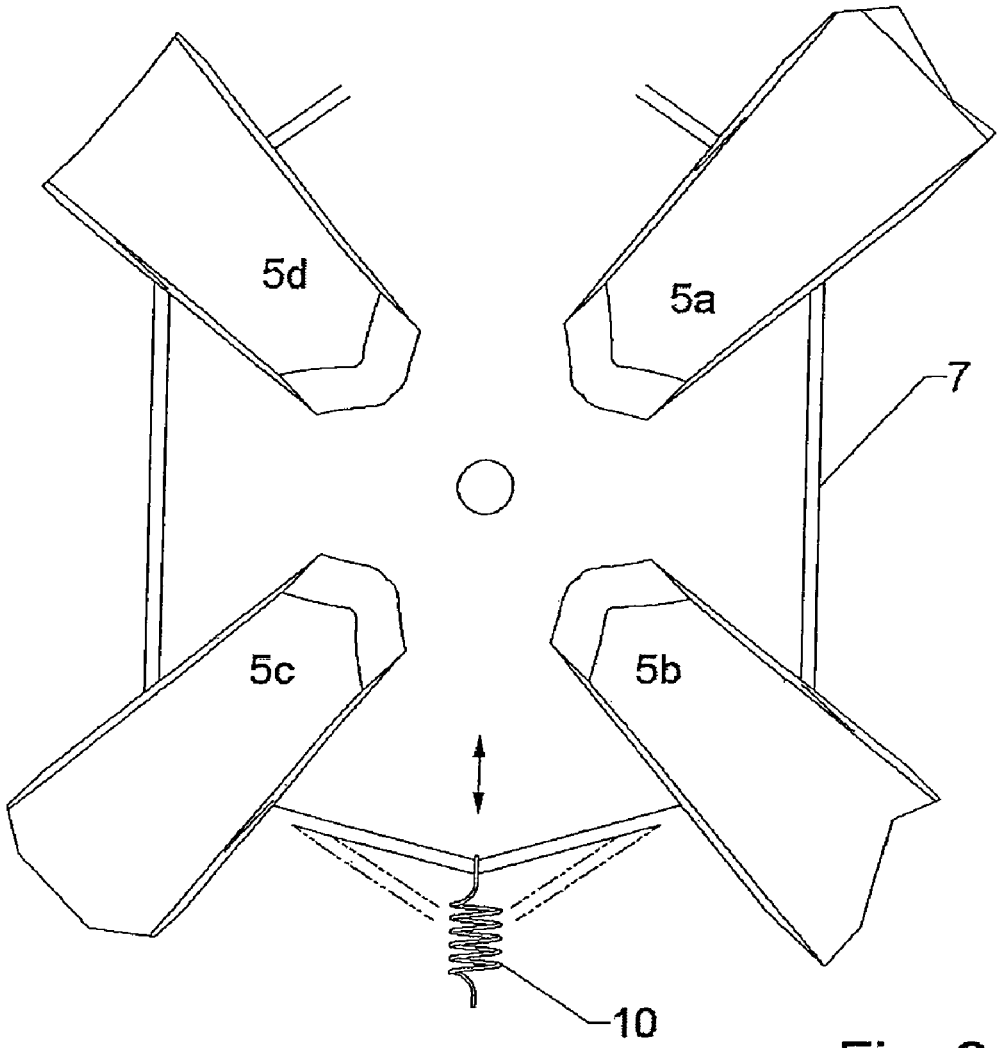
FIG. 2 is a schematically highly simplified top view of the receiving area of the same stand.

In accordance with FIG. 1, a tree stand 1 has a foot piece 2, e.g. a massive metal plate or the like, upon which or at which is arranged a receiving part 3 for receiving the trunk 4 of a tree. Retaining elements 5 for retaining the tree trunk 4 are arranged on the exterior circumference of the receiving element 3. They are pivotably movable in the radial direction such that they can be pivoted out of a loose position, in which the receiving part 3 is freely accessible for receiving the tree trunk 4, into a support position in which the retaining areas 11 of the retaining elements 5 are positioned largely force-free on the tree trunk 4, via an alignment position in which the retaining elements are positioned on the trunk with only relatively little force, into a retaining position in which the retaining elements securely clamp the trunk 4 with full force. "Relatively little force" shall be understood herein to be a force that is significantly less than the retaining force, but that is adequate for retaining the trunk for alignment. In order to bring the retaining elements 5 from the loose position into the retaining position, a tensioning device 6, for instance a conventional ratchet mechanism, is provided that clamps the retaining elements 5 via a force transmission element 7, for instance a steel cable, in the direction of the tree trunk, and that can be released again for removing the trunk. For this, as illustrated in the exemplary embodiment in accordance with FIG. 1, the steel cable 5 is slidably guided through appropriately dimensioned bores in the retaining elements 5 and its two ends meet in the ratchet mechanism 6 and are tautened there. In addition, the retaining elements 5 are pre-stressed in the direction of their loose position by restoring springs (not shown) such that after the tensioning apparatus releases, e.g., for removing the tree, they return to the loose position. As in particular illustrated in FIG. 2, an elastic buffer element in the form of a tension spring engages, at one of the ends of the tension spring, the force transmission element 7, specifically largely centrally between two of the retaining elements, and, at the other end of the tension spring, the receiving part 3, advantageously providing the force transmission element 7 pre-stress even when the force transmission element 7 is in the loose position.

Since the cable is slidably borne in the retaining elements 5, it pulls all of the retaining elements, when the cable ends are tautened by the tensioning device 6, against the force of the elastic buffer element (and where required against the restoring force of the restoring springs engaging the retaining elements) together in the direction of the tree trunk 4. Because of the slidability of the cable, at first, where required one after the other, all of the retaining elements 5 move into the support position against the trunk 4, specifically since the cable is pre-stressed by the elastic buffer element 8, using its force. This condition continues with further tensioning of the force transmission element 7 until the tensioning force of the force transmission element has completely overcome that of the buffer 8 and the trunk 4 is clamped with the full retaining force. In this interval, the retaining elements 5 are pressed elastically against the trunk 4 by the force transmission element 7 such that they hold the trunk 4 enough that it does not fall over when it is let go of but such that when aligning the trunk its pressure can yield.

Figure 3:
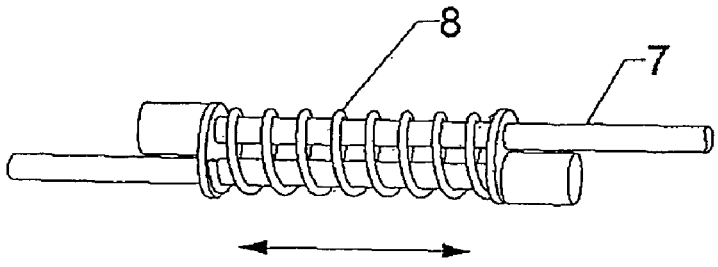
FIG. 3 is a buffer element arranged in the tensioning force direction between the ends of the force transmission elements.

Among other things, a spring that is itself integrated into the force transmission element 7 can be used as the elastic buffer element 8, which spring, as depicted in FIG. 3, after traveling the extent of its range of spring, blocks or its characteristic curve climbs such that the spring applies the retaining force necessary for securely retaining the trunk after it has passed through the alignment position. Under the same conditions, the force transmission element 7 itself can also be the elastic buffer.

Figure 4:
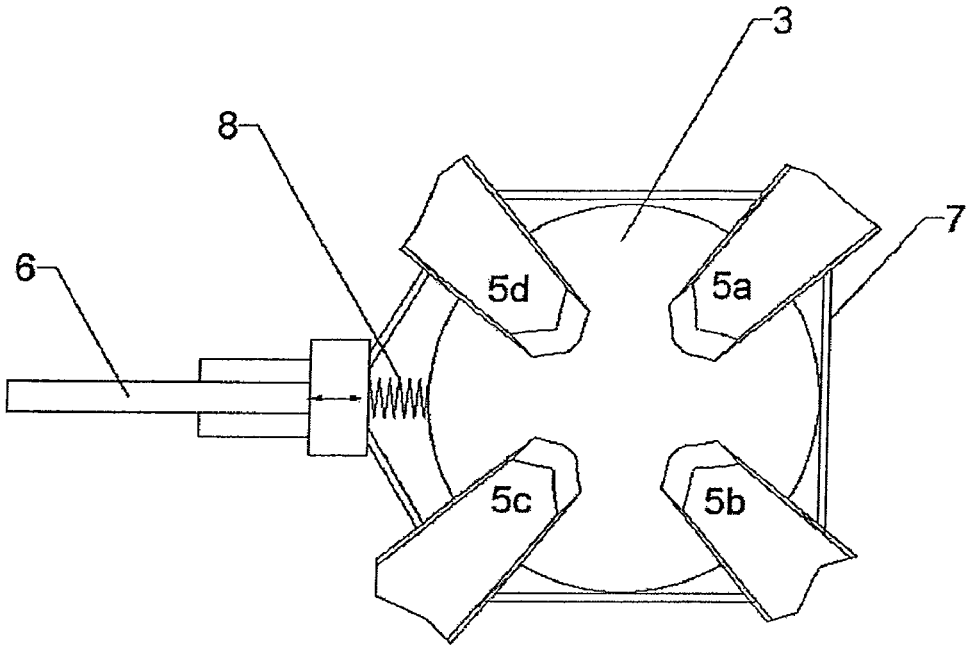
FIG. 4 is a schematically highly simplified top view of a stand in accordance with the patent with an elastic buffer element arranged in the area of the tensioning device.

FIG. 4 depicts the resilient bearing of the tensioning device. The rocker can also naturally be correspondingly resilient instead.

Figure 5:
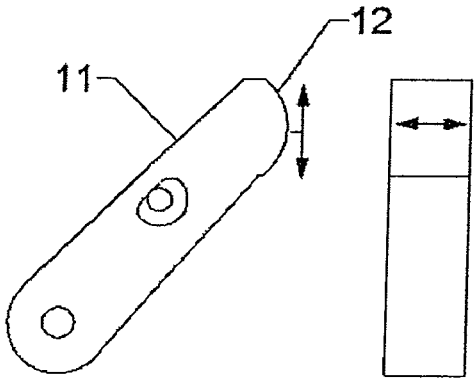
FIG. 5 is the retaining area of a retaining element with a rounded and slidable surface.

As FIG. 5 illustrates, in order to further facilitate the alignment, instead of the usual pointed tips or claws, the retaining area 11 on the retaining elements 5 can be provided with curved or rounded, slidable support surfaces 12 or with a flat support area, these sliding easily on the trunk 4 and not digging into it.

Figure 6:
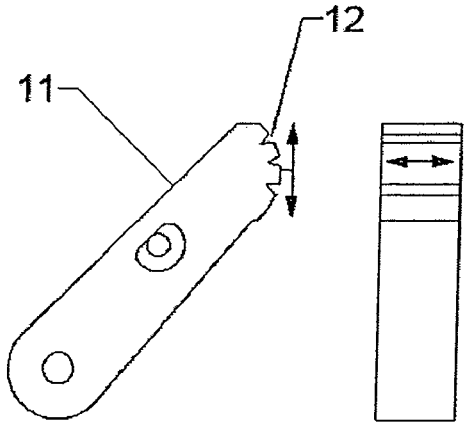
FIG. 6 is the retaining area of a retaining element with a toothed support surface.

In order to further enhance the retaining effect of the retaining elements 5 in the retaining position, as FIG. 6 illustrates, the support surface 12 can be provided with teeth with flattened tooth tips that slide on the trunk 4 at the slight forces applied in the alignment position and that do not dig into the trunk 4 until the high pressing forces applied for lasting retaining.

Figure 7:
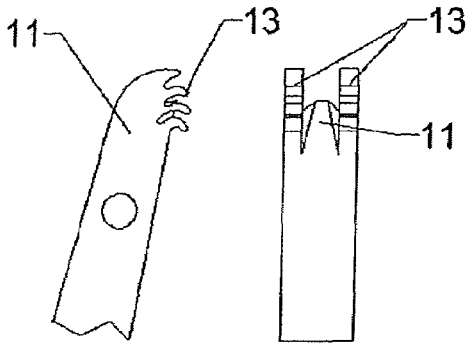
FIG. 7 is the retaining area of a retaining element with flexible tongues.
Figure 8:
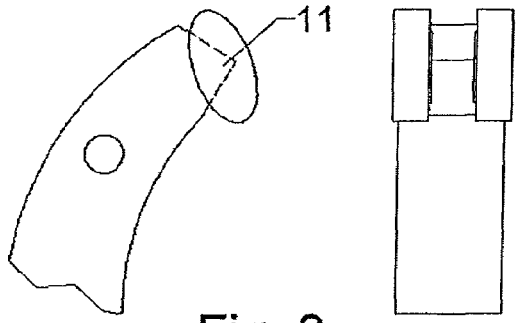
FIG. 8 is the retaining area of a retaining element with an elastomer support surface.
Figure 9:
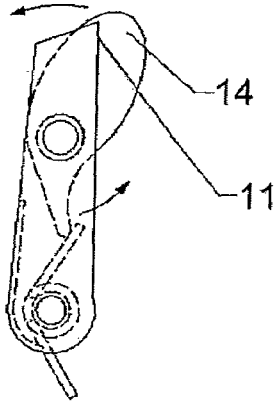
FIGS. 9 and 10 are the retaining areas of a retaining element with a spring buckle.
Figure 10:
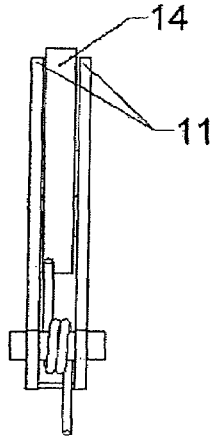
Figure 11:
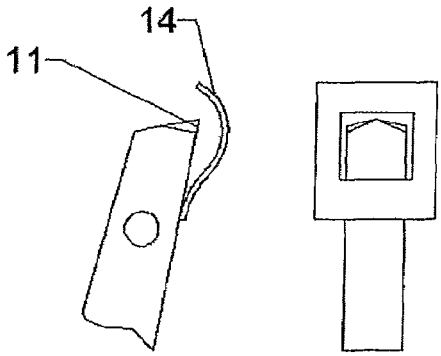
FIG. 11 is the retaining area of a retaining element with a spring block.

In order to further enhance the elasticity of the system in the alignment phase, the retaining elements 5 can be embodied in the retaining area 11 with flexible tongues 13 (FIG. 7) or elastomer (FIG. 8) or can be provided with a spring buckle 14 (FIG. 9, 10) or spring block 15 (FIG. 11).

Figure 12:
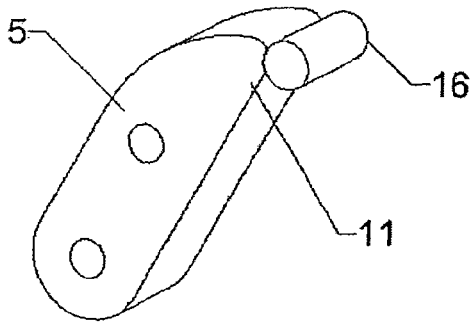
FIG. 12 is a perspective depiction of the retaining area of a retaining element with a cylindrical/roller-shaped body.

In order to further facilitate the alignment, as FIG. 12 illustrates, instead of the normal pointed tips or claws or the rounded, slidable support surfaces 12 illustrated in FIG. 5, the retaining area 11 on the retaining elements 5 can be provided with preferably cylindrical/roller-shaped resilient or rigid bodies 16 that are arranged with their longitudinal axis preferably tangential to the receiving area and that during alignment slide easily on the trunk 4 and do not dig in and that, if they are elastic, support the elasticity of the entire system.

Figure 13:
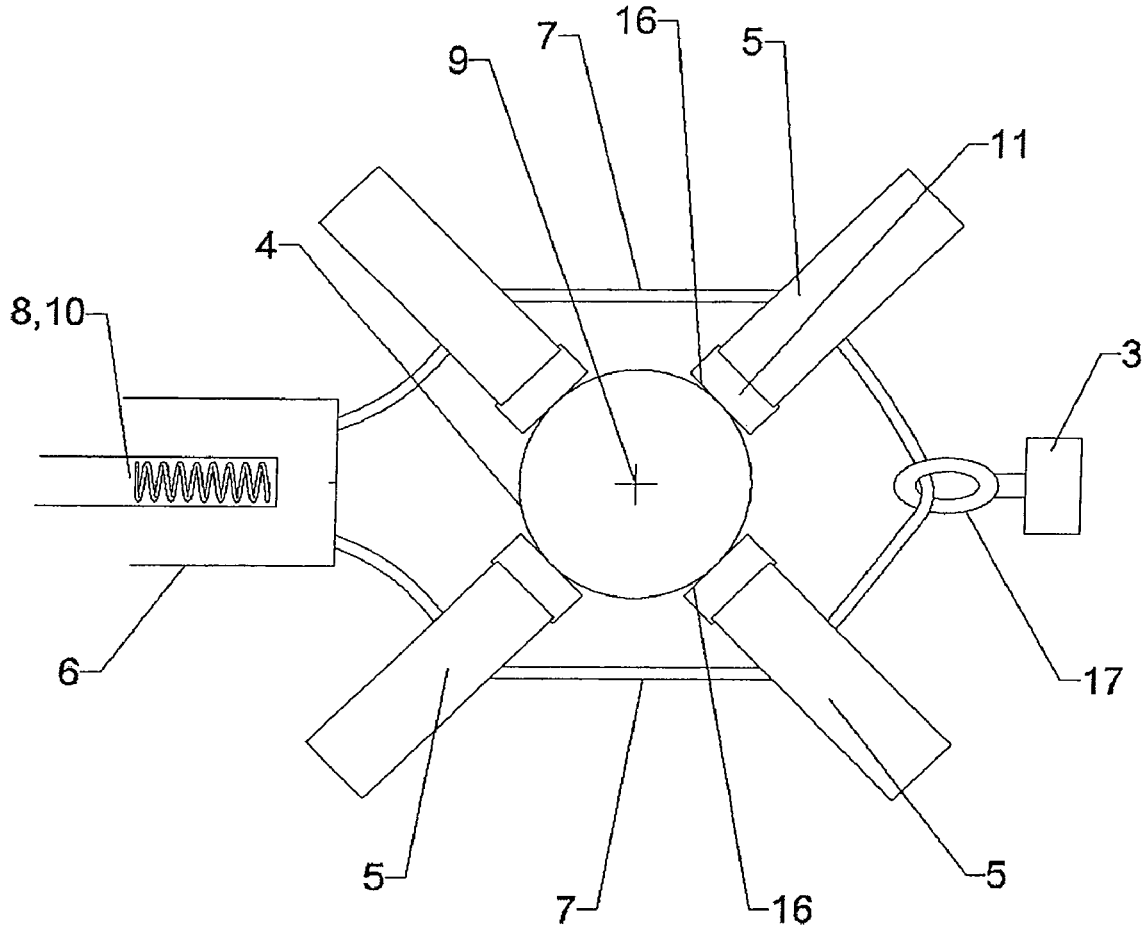
FIG. 13 is a schematically highly simplified top view of a stand in accordance with the invention with an elastic buffer element arranged in the area of the tensioning device, an annular slide guide for the force transmission element opposed thereto, and roller-shaped retaining areas of the retaining elements.

FIG. 13 depicts a particularly functional tree stand in which on the one hand the elastic buffer element 8 is arranged in the area of the tensioning device 6, whereby the tensioning device 6 is borne elastically such that it is movable against the spring force of the elastic buffer element 8 radially in the direction of the axis 9 of the receiving part 3 when the force transmission element 7 is tautened, and in which on the other hand the force transmission element 7 in the form of a steel cable is slidably guided on the side of the stand 1 opposing the tensioning device 6 on the receiving part 3 in an eye 17 fixed thereto and in which in addition the retaining areas 11 of the retaining elements 5 or their support surfaces 12 are embodied preferably as cylindrical/roller-shaped resilient or rigid bodies 16 arranged with their longitudinal axis preferably tangential to the receiving part 3. The slidable bearing of the force transmission element 7 on the side opposing the tensioning device 6 collects the tensioning forces directed to the tensioning device 6 that occur during tensioning, prevents forces acting laterally on the retaining elements, and improves the uniform distribution of the pressing forces of the retaining elements 5 on the trunk. The design of the retaining areas 11 or their support surfaces 12 as roller-shaped bodies 16 or the like enhances the sliding of the trunk 4 on them and thus further facilitates alignment. If these bodies 16 are embodied elastically, they also enhance the elasticity of the entire system without their slidability having to suffer for this.

LEGENDS

1 Tree stand
2 Foot piece
3 Receiving part
4 Trunk of a tree
5 Retaining element
6 Tensioning device
7 Force transmission element
8 Elastic buffer element
9 Axis of receiving part
10 Helical screw
11 Retaining area

12 Support surface/support area
13 Flexible tongue
14 Spring buckle
15 Spring block
16 Roller-shaped body
17 Eye

The invention claimed is:

1. A tree stand for receiving a lower portion of a trunk of a tree, comprising:

a foot piece;

a receiving part for receiving the lower portion of the trunk coaxially with an axis of the receiving part, the receiving part comprising retaining elements arranged about said axis a tensioning device;

a force transmission device operatively connecting the tensioning device to the retaining elements to move each of said retaining elements from a release position, in which the trunk is not retained by the retaining elements, then to a support position, in which the retaining elements engage the trunk with relatively little force thereby permitting alignment of the trunk in the receiving part, and then to a retaining position, in which the retaining elements securely clamp the trunk with sufficient force to prevent realignment of the trunk in the receiving part, said force transmission device comprising a flexible connecting device which is loadable by tension; and an elastic buffer element operatively connected to the force transmission device, said elastic buffer element exerting an elastic resistance in response to a tensioning applied to the force transmission device by operation of said tensioning device over a predetermined range of tightening of the force transmission device, said elastic buffer element ceasing to provide meaningful elastic buffering when a threshold is reached in a progressive tightening of the force transmission device by continued operation of the tensioning device, further tightening of said force transmission device beyond said threshold by operation of the tensioning device causing the tensioning device to have a substantially unbuffered effect on the force transmission element, such that, in the alignment position, the force transmission device presses the retaining elements against the trunk with a predetermined, adjustable force exerted by the elastic resistance of the elastic buffer element that is less than a force with which the force transmission device presses the retaining elements against the trunk in the retaining position with the substantially unbuffered effect present after the threshold has been exceeded, so that, in the alignment position, the trunk is supported substantially upright but is realignable prior to exceeding said threshold.

2. A tree stand according to claim 1, wherein the elastic buffer element exerts a force component directed away from the receiving part axis.

3. A tree stand according to claim 1, wherein the elastic buffer element comprises a helical spring.

4. A tree stand according to claim 2, wherein at least a portion of the flexible connecting device is elastic and comprises the elastic buffer element.

5. A tree stand according to claim 4, wherein the flexible connecting device is elastic in the direction of the tensioning with which it is loaded.

6. A tree stand according to claim 1, wherein the elastic buffer element is connected to the tensioning device in such arrangement that the elastic buffer element elastically changes in length in a radial direction with respect to the receiving part axis when tension is applied by the tensioning device.

7. A tree stand according to claim 1, further comprising, a guide which is fixedly connected to the foot piece and guides the force transmission device, the guide being substantially diametrically opposite the tensioning device.

8. A tree stand according to claim 7, wherein the guide comprises a ring.

9. A tree stand according to claim 1, wherein each of the retaining elements comprises a rigid or resilient cylindrical body for engaging the trunk, the cylindrical body having an axis substantially orthogonal to the axis of the receiving part.

10. A tree stand for receiving a lower portion of a trunk of a tree, comprising a foot piece;

a receiving part for receiving the trunk lower portion coaxially with an axis of the receiving part, the receiving part comprising retaining elements arranged about said axis;

a tensioning device;

a force transmission device operatively connecting the tensioning device to the retaining elements to move said retaining element from a release position, in which the trunk is not retained by the retaining elements, then to a support position, in which the retaining elements engage the trunk with relatively little force thereby to permit alignment of the trunk in the receiving part. and then to a retaining position, in which the retaining elements securely clamp the trunk with sufficient force to prevent realignment of the trunk in the receiving part, said force transmission device comprising a flexible connecting device which is loadable by tension; and an elastic buffer element operatively connected to the force transmission device thereby to act as an elastic resistance so that, in the alignment position the force transmission device presses the retaining elements against the trunk with a predetermined, adjustable force that is less than the force with which the force transmission device presses the retaining elements against the trunk in the retaining position so that, in the alignment position the trunk is supported substantially upright but is realignable, the elastic buffer element directly interconnecting the tensioning device and the force transmission device;

the tensioning device being radially movable with respect to the axis of the receiving part, such that when tension is applied to the force transmission device by the tensioning device, the tensioning device moves radially with respect to the axis of the receiving part against force applied by the elastic buffer element.

* * * * *